US005417628A

United States Patent [19]

Vanderbleek

[11] Patent Number: 5,417,628

[45] Date of Patent: May 23, 1995

[54] EXERCISE DEVICE FOR CHIN-UPS

[75] Inventor: James R. Vanderbleek, St. Petersburg, Fla.

[73] Assignee: Woolworth Corporation, New York, N.Y.

[21] Appl. No.: 301,253

[22] Filed: Sep. 6, 1994

[51] Int. Cl.[6] ..... A63B 1/00

[52] U.S. Cl. ..... 482/40; 482/904

[58] Field of Search ..... 482/39, 40, 148, 904, 482/55, 38, 41, 42

[56] References Cited

U.S. PATENT DOCUMENTS

| | | | |
|---|---|---|---|
| 3,915,452 | 10/1975 | Winblad | 482/40 |
| 4,458,894 | 7/1984 | Dudley | 482/40 |
| 4,529,191 | 7/1985 | Miller et al. | 482/40 |
| 4,844,448 | 7/1989 | Niznik | 482/904 |
| 5,306,217 | 4/1994 | Bracone | 482/55 |

*Primary Examiner*—Stephen R. Crow
*Attorney, Agent, or Firm*—Michael J. Colitz, Jr.; Dominik, Stein, Saccocio, Reese, Colitz & Van Der Wall

[57] ABSTRACT

An exercise device for chin-ups which comprises a first support of a rigid material which has a first end and a second end and a mid point therebetween positionable in a horizontal orientation with its ends adjacent to the upper extent of a door opening on the first side thereof. The first support has vertical exterior apertures adjacent to the ends and vertical interior apertures between the exterior apertures and the midpoint. Further included is a second support of a rigid material with a lower horizontal extent positioned upon the upper sill of a door opening on the second side thereof opposite from the first side and with a vertical extent positionable against a vertical wall surface above the upper sill. The board has a first end and a second end a midpoint therebetween with horizontal apertures extending therethrough adjacent to its ends. The length of the second support is less than the length of the first support with the midpoints in a common vertical plane. Further included is a pair of contoured tubes of a rigid material. Each tube has an upper free end and a lower free end and an intermediate point therebetween. The upper free ends has apertures with connectors for coupling to the second support through its apertures. The lower free ends have apertures with connectors for coupling to the first support through its exterior apertures. The intermediate points have apertures with associated bolts and nuts for coupling to the board through its interior aperture.

5 Claims, 4 Drawing Sheets

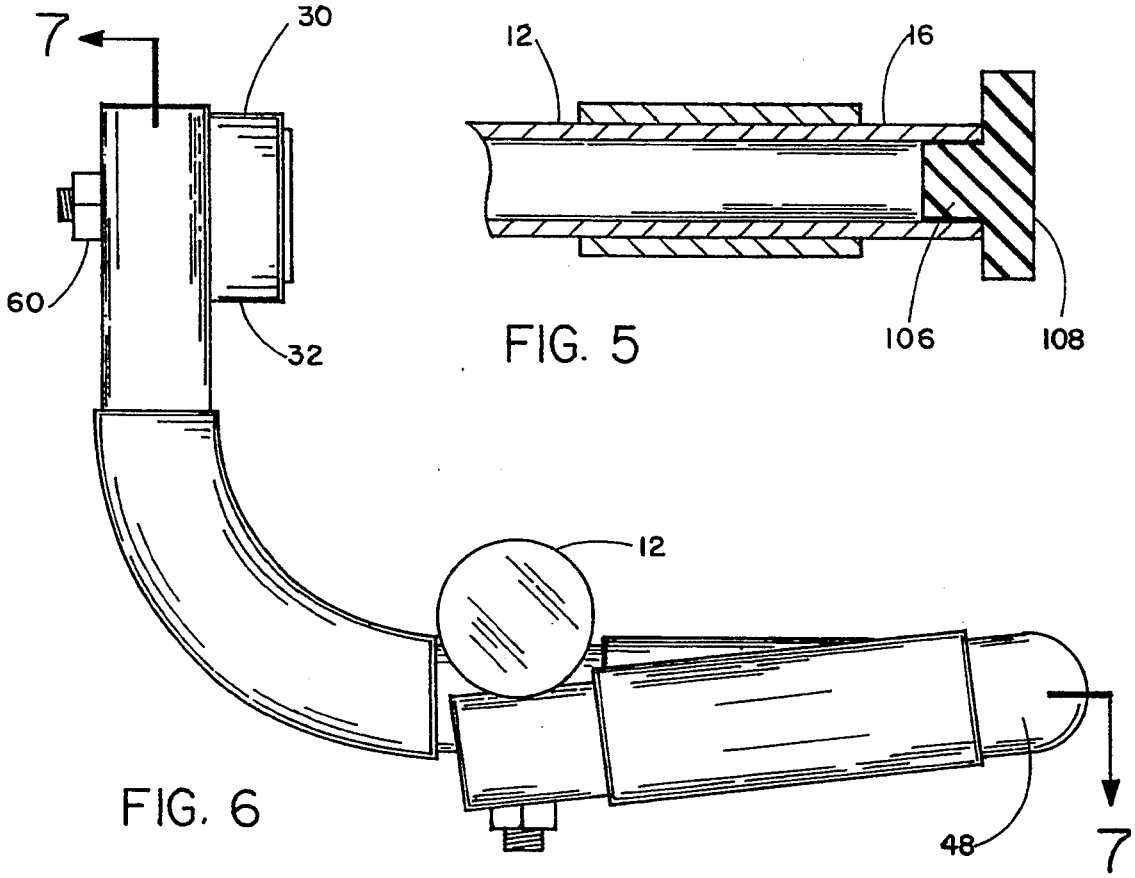
FIG. 6
FIG. 5
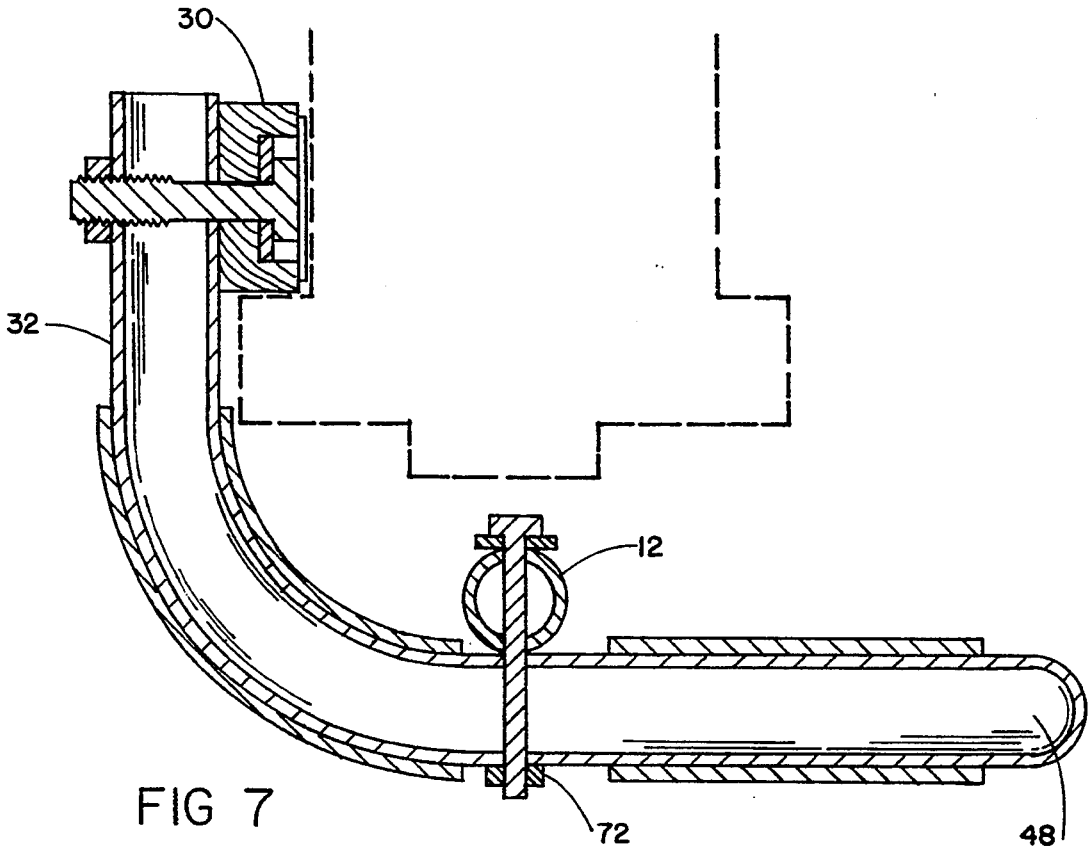
FIG 7

EXERCISE DEVICE FOR CHIN-UPS

BACKGROUND OF THE INVENTION

1. Field of the Invention

This invention relates to an exercise device for chin-ups and, more particularly, to securing a system of bars to the upper portion of a door opening through horizontal and vertical supports on opposite sides of the door.

2. Description of the Background Art

Presently, there is an ever increasing consciousness of health. To that end, an ever increasing number of people monitor their diet and take part in physical exercise so as to maintain health and increase their chances of longer lives.

Perhaps the most common form of exercise is walking and running. Such activities can only be done outside of the house unless the exerciser has access to an expensive treadmill or the like. Perhaps the most common indoor exercise are pull-ups and chin-ups. Such type of exercise requires minimum equipment in terms of size and cost. Pull-ups and chin-ups may readily be done on any convenient horizontal bar or support which may be grasped by a user. Such activities may be rendered more comfortable through any of a plurality of devices of modest cost and size which may be mounted with respect to a door frame. The great majority of devices of this type require coupling through screws or the like to the periphery of a door opening. Such coupling, however, normally involves the defacing of the door to leave an unsightly appearance when the device is removed.

As evidenced by a large number of prior art patents, efforts are continuing to improve exercise devices. Consider for example, U.S. Pat. No. Des. 210,469 to Sejersen which discloses an exercise bar; U.S. Pat. No. Des. 802,312 to Pierro which discloses an adjustable horizontal bar; U.S. Pat. Nos. 1,973,448 to Steen and Des. 258,140 to Smith which disclose a gymnastic apparatus; U.S. Pat. No. 1,430,573 to Lindstrom which discloses an exerciser; U.S. Pat. No. 3,526,399 to Hjelte which discloses a rotatably mounted exercising device with support frames; U.S. Pat. No. 3,593,996 to Thompson which discloses a chinning device; U.S. Pat. No. 3,716,232 to Johnson which discloses an exercise apparatus for attachment to an overhead frame; U.S. Pat. No. 4,243,219 to Price which discloses a portable lean-to exercising device; U.S. Pat. No. 4,458,894 to Dudley which discloses a portable support bar assembly; U.S. Pat. No. 4,529,191 to Miller which discloses a doorway mounted horizontal bar; U.S. Pat. No. 4,662,629 to Plovie which discloses an exercise device; U.S. Pat. No. 4,844,448 to Niznik which discloses a stand up exerciser; U.S. Pat. No. 4,883,268 to Saakind which discloses a compact, portable, rowing type exercise apparatus usable by a chair-seated exerciser; U.S. Pat. No. 4,976,428 to Ghazi which discloses a compact workout apparatus; U.S. Pat. Nos. 5,007,635 to Tiller and 4,662,629 to Plovie disclose an exercise device; U.S. Pat. No. 5,090,694 to Pauls which discloses a combination chair and exercise unit; U.S. Pat. No. 5,180,350 to Thomas which discloses an exercise bar apparatus.

As can be seen, the majority of the devices for assisting in the performing of chin-ups involves defacing that portion of a door opening. Such is unsightly. In the alternative, the coupling of devices may involve less than a secure coupling between the device and the door opening.

The most pertinent piece of prior art to the present invention is that to the Winblad U.S. Pat No. 3,915,452. Such device involves the first component positionable to rest on a horizontal surface above a door opening on one side thereof and a vertical surface positionable therebeneath on the opposite side of a door opening. Such device, however, is of a fixed construction and may not be adjusted to accommodate different door sizes. Further, there is but one single horizontal bar which may be utilized for being grasped during the performing of exercises with the device.

As will become evident, nothing in the prior art provides the benefits and advantages attendant with the present invention.

Accordingly, it is an object of this invention to provide an improvement which overcomes the aforementioned inadequacies of the prior art devices and provides an improvement which is a significant contribution to the advancement of the art.

Another object of this invention is to securely support a exercise device for chin-ups in a door opening.

Another object of this invention is to adjust an exercise device for chin-ups for accommodation in any of a plurality of sizes of door openings.

Another object of this invention is to suspend a plurality of grasping surfaces on an exercise device for chin-ups to be held by a user for performing any of a plurality of related exercises.

A further of the present invention is to preserve the integrity and appearances of door openings to accommodate exercise devices for chin-ups without defacing the door opening.

Another object of this invention is to provide an exercise device for chin-ups which comprises a first support of a rigid material which has a first end and a second end and a mid point therebetween positionable in a horizontal orientation with its ends adjacent to the upper extent of a door opening on the first side thereof. The first support has vertical exterior apertures adjacent to the ends and vertical interior apertures between the exterior apertures and the midpoint. Further included is a second support of a rigid material with a lower horizontal extent positioned upon the upper sill of a door opening on the second side thereof opposite from the first side and with a vertical extent positionable against a vertical wall surface above the upper sill. The board has a first end and a second end a midpoint therebetween with horizontal apertures extending therethrough adjacent to its ends. The length of the second support is less than the length of the first support with the midpoints in a common vertical plane. Further included is a pair of contoured tubes of a rigid material. Each tube has an upper free end and a lower free end and an intermediate point therebetween. The upper free ends has apertures with connectors for coupling to the second support through its apertures. The lower free ends have apertures with connectors for coupling to the first support through its exterior apertures. The intermediate points have apertures with associated bolts and nuts for coupling to the board through its interior aperture. The contoured tubes each have an upper part in a vertical curved configuration. The lower part of each contoured tube is in a V-shaped configuration with the apex on the side of the first support opposite from the curved portion. Foam grips are located on the bar.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an exercise device for chin-ups comprising, in combination, a tubular bar of a rigid metal material which has a first end and a second end and a mid point therebetween positionable in a horizontal orientation with its ends adjacent to the upper extent of a door opening on the first side thereof. The bar has vertical exterior apertures adjacent to the ends and vertical interior apertures between the exterior apertures and the midpoint. Further included is a board of a rigid wooden material which has a rectangular cross section with a lower horizontal extent positioned upon the upper sill of a door opening on the second side thereof opposite from the first side and with a vertical extent positionable against a vertical wall surface above the upper sill. The board has a first end and a second end a midpoint therebetween with horizontal apertures extending therethrough adjacent to its ends. The length of the board is less than the length of the bar with the midpoints in a common vertical plane. Further included is a pair of contoured tubes of a rigid metal material. Each tube has an upper free end and a lower free end and an intermediate point therebetween. The upper free ends have apertures with associated bolts and nuts for coupling to the board through its apertures. The lower free ends have apertures with associated bolts and nuts for coupling to the bar through its exterior apertures. The intermediate points have apertures with associated bolts and nuts for coupling to the bar through its interior aperture. The contoured tubes each have an upper part in a vertical curved configuration forming an arc of about ninety degrees. The lower part of each contoured tube is in a generally horizontal V-shaped configuration with the apex on the side of the bar opposite from the curved portion. The upper parts and the adjacent legs of the lower parts of the contoured tubes are in common parallel vertical planes with the legs of the contoured tubes adjacent to the lower free end being linear and at an angle of about fifteen degrees with respect to the adjacent legs. Foam grips are located on each leg on opposite sides of the apex and along the arcuate upper parts with additional grips on the bar between the legs and interiorly thereof.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5 is a cross sectional view taken along line 5—5 of FIG. 3.

FIG. 6 is a side elevational view of the device of the prior Figures.

FIG. 7 is a cross sectional view similar to FIG. 5.

Similar reference characters refer to similar parts throughout the several Figures.

DETAILED DESCRIPTION OF THE PREFERRED EMBODIMENT

Figure 1:
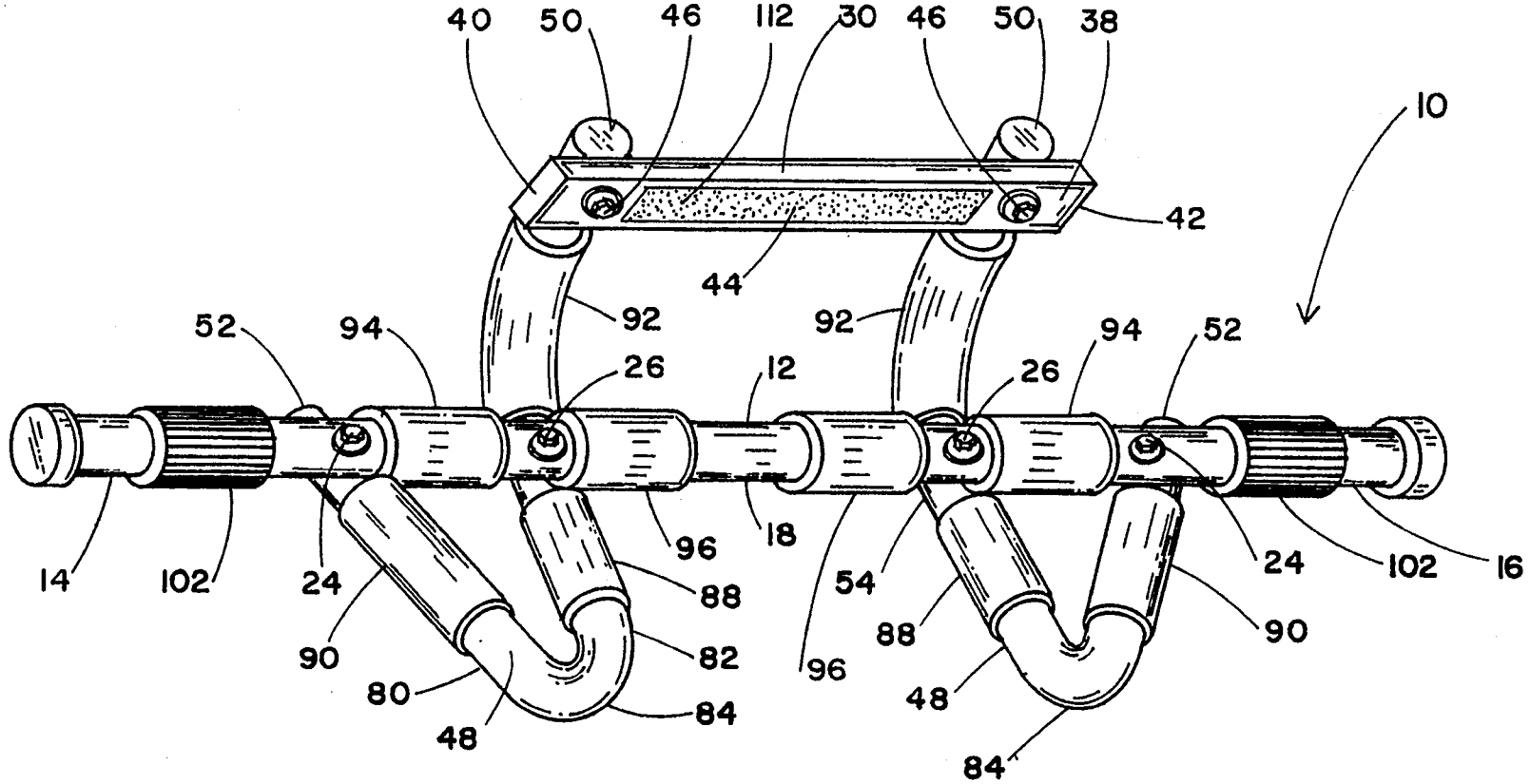
FIG. 1 is a perspective illustration of the preferred embodiment of the new and improved exercise device for chin-ups constructed in accordance with the principles of the present invention.
Figure 2:
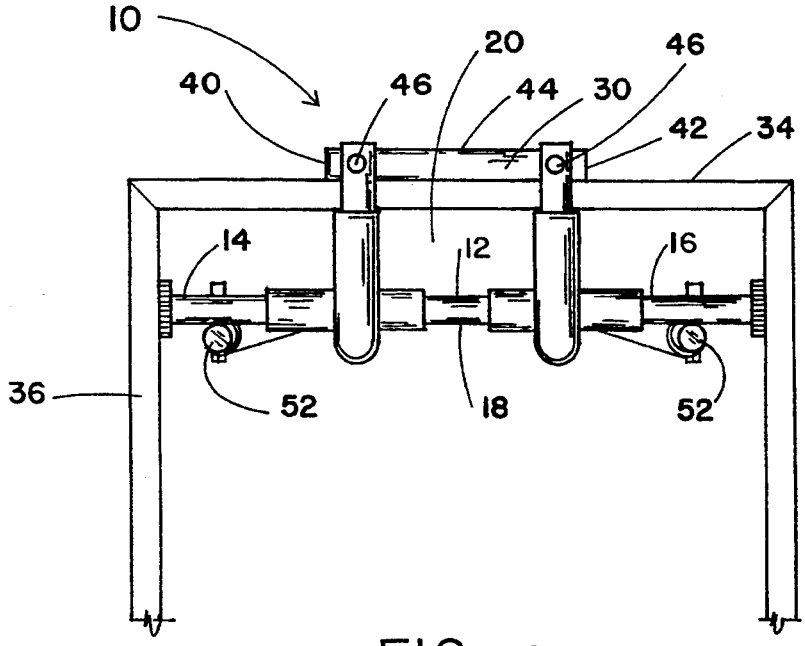
FIG. 2 is a rear elevational view of the device shown in FIG. 1.

The present invention, the new and improved exercise device for chin-ups is comprised of a plurality of components. Such components in their broadest context include a tubular bar, a wooden board, a pair of contoured tubes and foam grips. Such components are individually configured and correlated with respect to each other so as to attain the desired objective.

A central component of the system 10 of the present invention is a tubular bar 12. The tubular bar is fabricated of a rigid material preferably metal. It has a first end 14 and a second end 16. It also has a midpoint 18 between the two ends. In operation and use, the tubular bar 12 is adapted to be positioned in a horizontal orientation. In such orientation, its ends are located adjacent to the upper extent of the door opening 20 of the first side 22 of such opening. The bar has vertical exterior apertures 24 adjacent to the ends. It also has vertical interior apertures 26 between the exterior apertures and the midpoint.

The next major component of the system 10 is a wooden board 30. Such board has a rectangular cross sectional configuration. Such configuration includes a lower horizontal extent 32. Such extent is positioned upon the upper sill 34 of a door opening on the second side 36 thereof. Such second side is opposite from the first side.

The board also includes a vertical extent 38. Such vertical extent is positionable against a vertical wall surface above the upper sill 34. Like the tubular bar, the board has a first end 40 and a second end 42 and a midpoint 44 therebetween. Horizontal apertures 46 extend through the board adjacent to its end. In the preferred embodiment, the length of the board is less than the length of the bar. When coupled together, the midpoints 18, 44 of the bar and board are in a common vertical plane.

The next major component of the system 10 is a pair of contoured tubes 48. Such tubes are preferably fabricated of a rigid metal material. Each of the tubes has an upper free end 50 and a lower free end 52. Each tube also has an intermediate point 54 therebetween. The upper free ends of the tubes have apertures 56 with associated bolts 58 and nuts 60 for coupling to the board through its apertures. The lower free ends have apertures 62 with associated bolts 64 and nuts 66 for coupling the board through its exterior apertures. The intermediate points of the tubes also have apertures 68 with associated bolts 70 and nuts 72. Such are for coupling to the bar through its interior apertures.

Each of the contoured tubes has an upper part 76 and a lower part 78. The upper part is in a vertical curved configuration forming an arch of about ninety degrees. The lower part of each contoured tube is in a generally horizontal V-shaped configuration. Such configuration includes an exterior leg 80, an interior leg 82 and an apex 84 on the side of the board on the side of the bar opposite from the curved portion. The upper parts and adjacent lengths of the lower parts of the contoured tubes are located in common vertical planes. The exterior legs of the contoured tubes adjacent to the lower free ends are linear. They form an angle of about fifteen degrees with respect to their adjacent legs.

The next component of the system 10 is a plurality of foam grips. Such grips include grips 88 and 90 located on each leg on opposite sides of the apex. Similar grips 92 are located on the arcuate upper parts of the contoured tubes. Additional grips 94 and 96 are located on the bar between the legs and interiorly thereof. A plurality of gripping locations are thus provided for a plurality of exercises.

Figure 3:
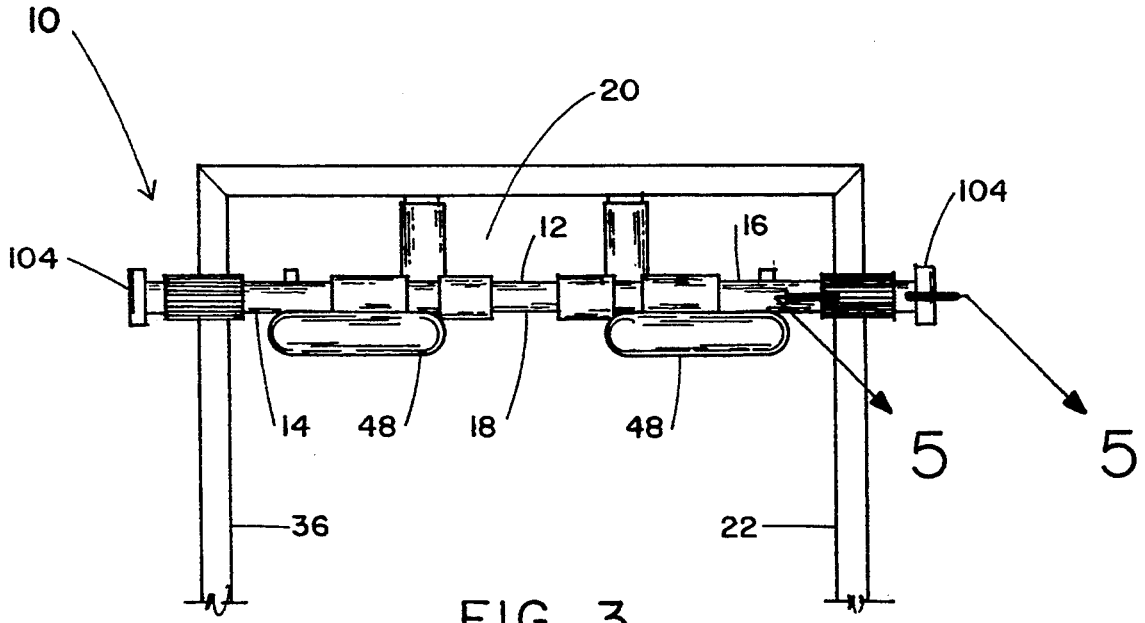
FIG. 3 is a front elevational view of the device of FIGS. 1 and 2.
Figure 4:
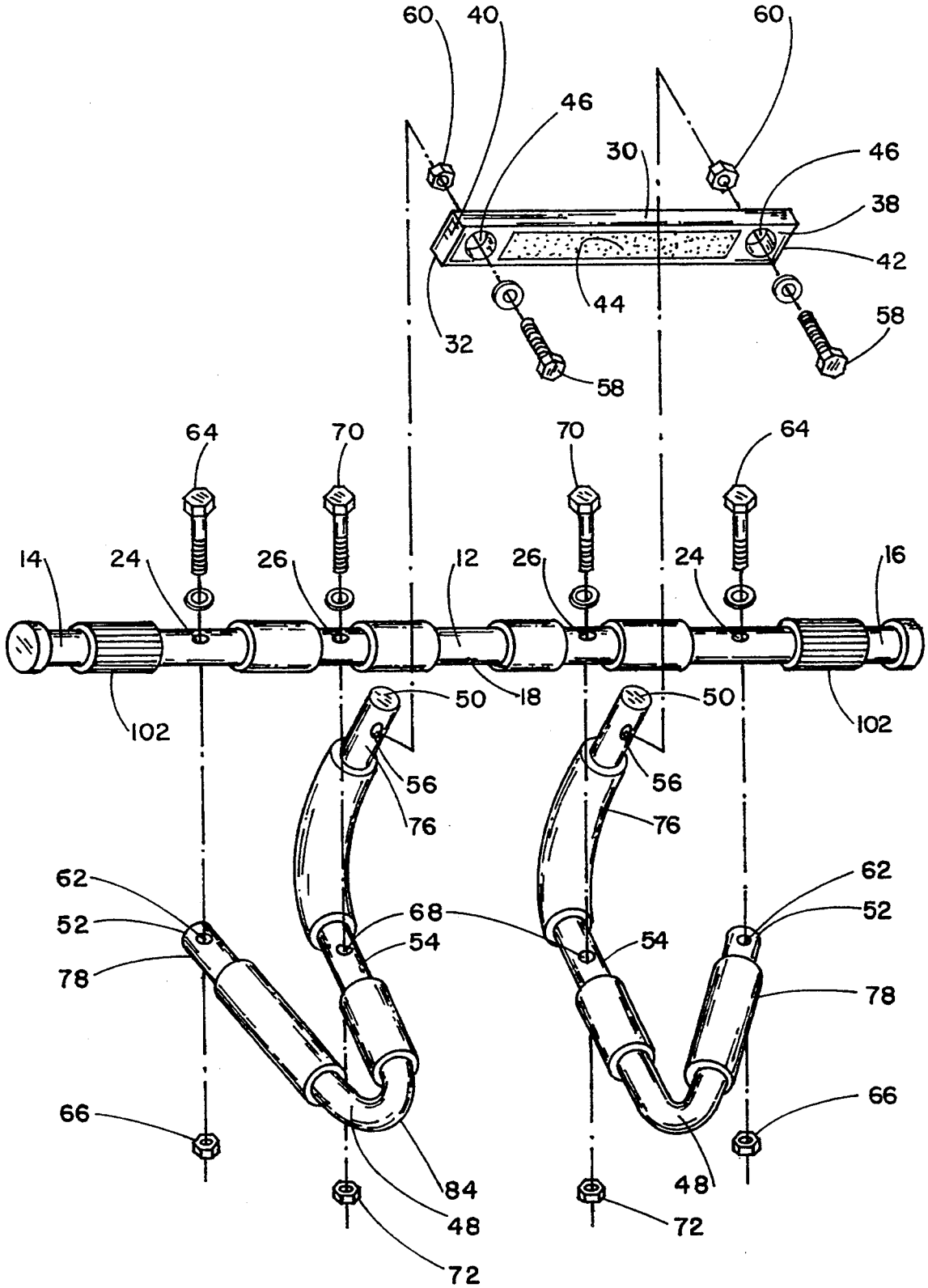
FIG. 4 is an exploded perspective view of the device shown in the prior Figures.

The last component of the system 10 is intended to extent the utility thereof and to preclude damage to the sill of a door way with which the device is to be utilized. Such feature includes sleeves 102. Such sleeves are cylindrical in configuration and adapted to be received over the ends of the tubular bar. They may be moved inboardly or outboardly with respect thereto. Do to the frictional coupling the interior surface and the exterior surface of the ends of the tubular bar, they will tend to remain in the position where last positioned unless slid axially in one direction or another by a user. Such positioning is preferably such that they will contact the normally wooden surface of a door opening therearound. Note in particular FIG. 3. In association therewith, end caps 104 in the form of cylindrical smaller interior ends 86 and larger exterior ends 108 are utilized. The interior ends are press-fit into the open ends of the tubular bar. The large exterior ends are of an increased diameter. In this manner, the stoppers form an abutment surface to preclude inadvertent removal of the sleeves from the tubular bar.

A further feature to preclude damage to the wall against which the device is to be utilized is as elastomeric tape 112. Such tape is adhesively secured onto the interior face or extent 38 of the board 30. It has a roughened exterior face to promote frictional contact and thereby preclude inadvertent movement. The material from which it is made abates scratching of the contacted wall surface.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An exercise device for chin-ups comprising, in combination:

a tubular bar of a rigid metal material having a first end and a second end and a mid point therebetween positionable in a horizontal orientation with its ends adjacent to the upper extent of a door opening on the first side thereof, the bar having vertical exterior apertures adjacent to the ends and vertical interior apertures between the exterior apertures and the midpoint;

a board of a rigid wooden material having a rectangular cross section with a lower horizontal extent positioned upon the upper sill of a door opening on the second side thereof opposite from the first side and with a vertical extent positionable against a vertical wall surface above the upper sill, the board having a first end and a second end a midpoint therebetween with horizontal apertures extending therethrough adjacent to its ends, the length of the board being less than the length of the bar with the midpoints in a common vertical plane;

a pair of contoured tubes of a rigid metal material, each tube having an upper free end and a lower free end and an intermediate point therebetween, the upper free ends having apertures with associated bolts and nuts for coupling to the board through its apertures, the lower free ends having apertures with associated bolts and nuts for coupling to the bar through its exterior apertures, the intermediate points having apertures with associated bolts and nuts for coupling to the bar through its interior aperture, the contoured tubes each having an upper part in a vertical curved configuration forming an arc of about ninety degrees, the lower part of each contoured tube being in a generally horizontal V-shaped configuration with the apex on the side of the bar opposite from the curved portion, the upper parts and the adjacent legs of the lower parts of the contoured tubes being in common parallel vertical planes with the legs of the contoured tubes adjacent to the lower free end being linear and at an angle of about fifteen degrees with respect to the adjacent legs; and foam grips located on each leg on opposite sides of the apex and along the arcuate upper parts with additional grips on the bar between the legs and interiorly thereof.

2. An exercise device for chin-ups comprising:

a first support of a rigid material having a first end and a second end and a mid point therebetween positionable in a horizontal orientation with its ends adjacent to the upper extent of a door opening on the first side thereof, the first support having vertical exterior apertures adjacent to the ends and vertical interior apertures between the exterior apertures and the midpoint;

a second support of a rigid material with a lower horizontal extent positioned upon the upper sill of a door opening on the second side thereof opposite from the first side and with a vertical extent positionable against a vertical wall surface above the upper sill, the board having a first end and a second end a midpoint therebetween with horizontal apertures extending therethrough adjacent to its ends, the length of the second support being less than the length of the first support with the midpoints in a common vertical plane;

a pair of contoured tubes of a rigid material, each tube having an upper free end and a lower free end and an intermediate point therebetween, the upper free ends having apertures with connectors for coupling to the second support through its apertures, the lower free ends having apertures with connectors for coupling to the first support through its exterior apertures, the intermediate points having apertures with associated bolts and nuts for coupling to the board through its interior aperture, the contoured tubes each having an upper part in a vertical curved configuration, the lower part of each contoured tube being in a V-shaped configuration with the apex on the side of the first support opposite from the curved portion; and foam grips located on the bar.

3. The device as set forth in claim 2 and further including foam grips on the lower parts of the contoured tubes.

4. The device as set forth in claim 2 wherein the foam grips are located on each leg on opposite sides of the apex and along the arcuate upper parts with additional grips on the bar between the legs and interiorly thereof.

5. The device as set forth in claim 2 and further including resilient abutment sleeves on the tubular bar adjacent to each end and an end cap located within each end of the tubular bar.

* * * * *